US008876564B2

(12) United States Patent
Sato

(10) Patent No.: US 8,876,564 B2
(45) Date of Patent: Nov. 4, 2014

(54) CONNECTION STRUCTURE OF CRIMPING TERMINAL TO ELECTRIC WIRE

(75) Inventor: Kei Sato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 74 days.

(21) Appl. No.: 13/583,036

(22) PCT Filed: Mar. 8, 2011

(86) PCT No.: PCT/JP2011/055420

§ 371 (c)(1),
(2), (4) Date: Sep. 6, 2012

(87) PCT Pub. No.: WO2011/114950

PCT Pub. Date: Sep. 22, 2011

(65) Prior Publication Data

US 2012/0329342 A1 Dec. 27, 2012

(30) Foreign Application Priority Data

Mar. 19, 2010 (JP) ..... 2010-065085

(51) Int. Cl.

| | |
|---|---|
| ***H01R 9/05*** | (2006.01) |
| ***H01R 4/20*** | (2006.01) |
| ***H01R 4/18*** | (2006.01) |
| *H01R 4/62* | (2006.01) |

(52) U.S. Cl.

CPC *H01R 4/206* (2013.01); *H01R 4/62* (2013.01); *H01R 4/184* (2013.01)

USPC ..... 439/879

(58) Field of Classification Search

CPC ... H01R 9/0518; H01R 12/69; H01R 13/5808

USPC ..... 439/879–882

See application file for complete search history.

(56) References Cited

U.S. PATENT DOCUMENTS 2,427,182 A * 9/1947 Bergan ..... 439/787
3,697,669 A * 10/1972 O'Loughlin et al. ..... 174/84 C (Continued)

FOREIGN PATENT DOCUMENTS

EP 0018863 A1 3/1980
JP 55150569 A 11/1980

(Continued)

OTHER PUBLICATIONS

International Search Report dated Apr. 5, 2011 issued in International Application No. PCT/JP2011/055420 (PCT/ISA/210).

(Continued)

*Primary Examiner* — Truc Nguyen
(74) *Attorney, Agent, or Firm* — Sughrue Mion, PLLC

(57) ABSTRACT

In a connection structure of a crimping terminal to an electric wire, the crimping terminal having an electric connection part in the front thereof, and an electric wire connection part formed in substantially a U shape in cross-section view by having a base plate part, and a pair of electric wire crimp pieces upwardly extending from both lateral edges of the base plate part in the back of the electric connection part, a metallic cap whose inner periphery is provided with serrations is attached to a distal end of the electric wire so as to cover the range from an exposed conductor-to the portion of an insulating coating, and the conductor and the insulating coating of the electric wire are bitten into the serrations by crimping the electric wire crimp pieces so as to surround the cap.

3 Claims, 3 Drawing Sheets

(56) References Cited

U.S. PATENT DOCUMENTS

| | | | | |
|---|---|---|---|---|
| 7,160,156 | B2 * | 1/2007 | Holliday | 439/879 |
| 7,632,144 | B2 * | 12/2009 | Sakaguchi et al. | 439/585 |
| 2002/0050385 | A1 | 5/2002 | Murakami et al. | |
| 2005/0227549 | A1 | 10/2005 | Takayama | |
| 2007/0249225 | A1 * | 10/2007 | Sakaguchi et al. | 439/578 |

FOREIGN PATENT DOCUMENTS

| | | | |
|---|---|---|---|
| JP | 2002124310 | A | 4/2002 |
| JP | 2004207172 | A | 7/2004 |
| JP | 2007-294238 | A | 11/2007 |

OTHER PUBLICATIONS

Written Opinion dated Apr. 5, 2011 issued in International Application No. PCT/JP2011/055420 (PCT/ISA/237).

Office Action dated Feb. 21, 2014 issued by the Japanese Patent Office in counterpart Japanese Patent Application No. 2010-065085.

Office Action dated Jul. 10, 2014 issued by the State Intellectual Property Office of the People's Republic of China in counterpart Chinese Patent Application No. 201180014599.9.

Office Action issued Aug. 13, 2014 by the Japanese Patent Office in corresponding Japanese Application No. 2010-065085.

* cited by examiner

CONNECTION STRUCTURE OF CRIMPING TERMINAL TO ELECTRIC WIRE

CROSS REFERENCE TO RELATED APPLICATIONS

This application is a National Stage entry of International Application No. PCT/JP2011/055420 filed Mar. 8, 2011, claiming the benefit of Application No. JP 2010-065085 filed Mar. 19, 2010, in the Japanese Patent Office (JPO), the disclosures of which are incorporated herein in their entirety.

TECHNICAL FIELD

The present invention relates to a connection structure of a crimping terminal to an electric wire.

BACKGROUND ART

FIG. 5 shows a connection structure between a terminal and an electric wire described in Patent Reference 1.

In this connection structure between the terminal and the electric wire, as shown in FIGS. 5(*a*) and 5(*b*), a metallic cap 230 with the size in which the range from a conductor (mainly including a twisted wire obtained by twisting many strands together) Wa exposed by removing an insulating coating Wb to the portion having the insulating coating Wb is covered is first attached to the distal end of an electric wire W, and the insertion portion of the conductor Wa of the distal end of the electric wire W to which the cap 230 is attached is placed on a base plate part 221 of an electric wire connection part 212 formed in the back of a terminal 210. In that state, as shown in FIG. 5(*c*), a pair of conductor crimp pieces 222 extending in both lateral edges of the base plate part 221 is crimped so as to obtain a state in which the conductor Wa and the cap 230 make close contact with an upper surface of the base plate part 221 by inwardly bending the conductor crimp pieces 222 so as to wrap the conductor Wa and the cap 230.

In the cap 230, a portion 231 into which the outer periphery of the conductor Wa is fitted is formed in a tube shape with a small diameter, and an inlet side portion 232 into which the outer periphery of the insulating coating Wb is fitted is formed in a tube shape with a large diameter, and a gap between the conductor Wa and the cap 230 is filled with a waterproof filler (not shown). Also, an inner peripheral surface of the electric wire connection part 212 of the terminal 210 is provided with serrations 228 for increasing contact continuity between the cap 230 and the terminal 210.

The reason why the cap 230 is used herein is because electrolytic corrosion may occur when water adheres to a part of contact between different kinds of metals (that is, a crimping part) in the case where, for example, the conductor Wa of the electric wire W is made of aluminum or aluminum alloy and the terminal 210 is made of copper or copper alloy, and a material of the cap 230 is set in the same kind (copper or copper alloy) as a material of the terminal 210. A terminal made of aluminum or aluminum alloy can also be used for an aluminum electric wire, but a terminal made of copper or copper alloy has an advantage over the terminal made of aluminum or aluminum alloy in strength. When the materials are selected thus, the cap 230 is made of metal different from that of the conductor Wa of the electric wire W (the former is made of copper or copper alloy and the latter is made of aluminum or aluminum alloy), but a gap between the conductor Wa and the cap 230 is filled with a filler (not shown), and water is prevented from entering the inside of the cap 230 and there is no fear of electrolytic corrosion.

PRIOR ART REFERENCE

Patent Reference

Patent Reference 1: JP-A-2004-207172

DISCLOSURE OF THE INVENTION

Problems that the Invention is to Solve

Incidentally, in the conventional connection structure between the terminal and the electric wire described above, water is prevented from entering the inside of the cap 230 by filling the gap between the cap 230 and the conductor Wa of the electric wire W with the filler, but the filler is used, so that there was a problem that a control item at the time of actual use increased and it was not practical.

The invention has been implemented in view of the circumstances described above, and an object of the invention is to provide a connection structure of a crimping terminal to an electric wire capable of preventing water from entering the inside of a cap without using a filler and thereby decreasing a control item to improve practicality.

Means for Solving the Problems

In order to achieve the object described above, a connection structure of a crimping terminal to an electric wire according to the invention is characterized by the following (1) to (3).

(1) A connection structure of a crimping terminal to an electric wire, the crimping terminal having an electric connection part for making connection to the other terminal in the front of the crimping terminal, and an electric wire connection part formed in substantially a U shape in cross-section view by having a base plate part, and a pair of electric wire crimp pieces which upwardly extends from both lateral edges of the base plate part and is crimped so as to obtain a state in which a distal end of the electric wire is brought into close contact with an upper surface of the base plate part by inwardly bending the electric wire crimp pieces so as to wrap the distal end of the electric wire to be connected in the back of the electric connection part, wherein a metallic cap whose inner periphery is provided with a serration is attached to a conductor exposed by removing a portion of an insulating coating of the distal end of the electric wire so as to cover a range to the coating portion of the electric wire, and the conductor and the insulating coating of the electric wire are bitten into the serration by crimping the electric wire crimp pieces so as to surround the cap.

(2) In the connection structure of the crimping terminal to the electric wire with the configuration of the above (1), the cap has a tubular peripheral wall in which one end of a longitudinal direction is closed and the other end is opened, and the serration is formed as a continuous annular groove in an inner periphery of the tubular peripheral wall in a portion into which at least the insulating coating is bitten, and the serration intersects with a longitudinal direction of the electric wire.

(3) In the connection structure of the crimping terminal to the electric wire with the configuration of the above (1) or (2), the cap is formed of a metal of the same kind as that of the terminal.

According to the connection structure of the crimping terminal to the electric wire with the configuration of the above (1), the conductor and the insulating coating of the electric wire are bitten into the serration formed in the inner periphery of the cap, so that performance of electrical continuity between the cap and the conductor of the electric wire can be improved. Also, a force of bonding or adhesion between the cap and the insulating coating of the electric wire can be increased by biting the insulating coating of the electric wire into the serration. Therefore, entrance of water is blocked at that bitten portion and even when a filler is not used, sufficient waterproof performance can be maintained. As a result, the need for a control item of the filler is eliminated and thereby, practicality improves more and ease-of-use improves.

According to the connection structure of the crimping terminal to the electric wire with the configuration of the above (2), the serration into which at least the insulating coating is bitten intersects with the longitudinal direction of the electric wire by being formed as the continuous annular groove in the inner periphery of the tubular peripheral wall of the cap, so that an entrance path of water is blocked at the portion in which the insulating coating is bitten into the serration, and waterproof performance can be improved more surely.

According to the connection structure of the crimping terminal to the electric wire with the configuration of the above (3), the cap is constructed of a metal of the same kind as that of the terminal, so that electrolytic corrosion does not occur even when water adheres to a part of contact between the cap and the terminal.

Advantage of the Invention

According to the invention, by biting the insulating coating of the electric wire into the serration formed in the inner periphery of the cap, water can be prevented from entering the inside of the cap without using a filler and thereby a control item of the filler can be decreased to improve practicality. Also, performance of electrical continuity between the cap and the conductor of the electric wire can be improved by biting the conductor of the electric wire into the serration.

The invention has been described above briefly. Further, the details of the invention will become more apparent by reading through a mode for carrying out the invention described below with reference to the accompanying drawings.

MODE FOR CARRYING OUT THE INVENTION

An embodiment of the invention will hereinafter be described with reference to the drawings.

Figure 1:
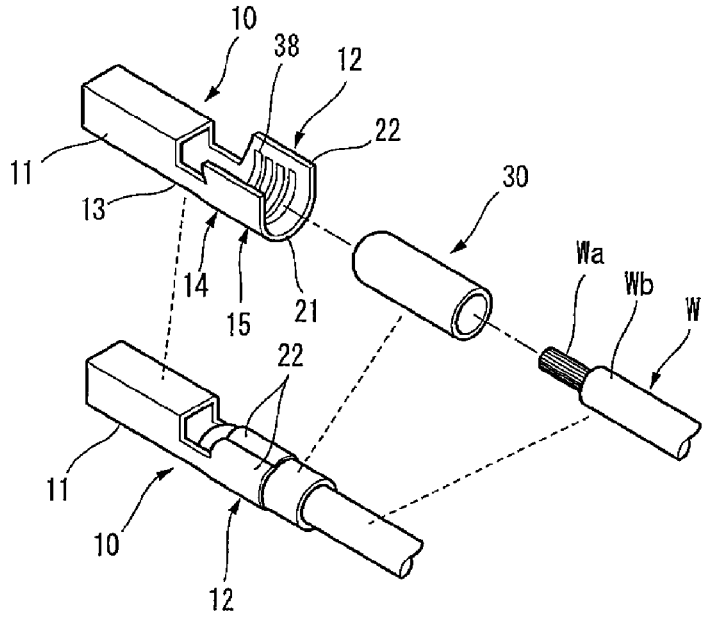
FIG. 1 is an explanatory diagram of an embodiment of the invention and is a completion perspective view and an exploded perspective view showing a relation among a crimping terminal, an electric wire and a cap.
Figure 2A:
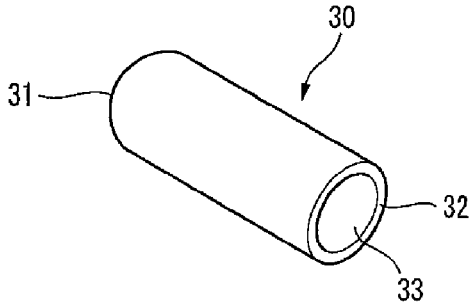
FIG. 2(*a*) is an outline perspective view of the cap, and FIG. 2(*b*) is a sectional view showing an internal structure of the half-divided cap.
Figure 2B:
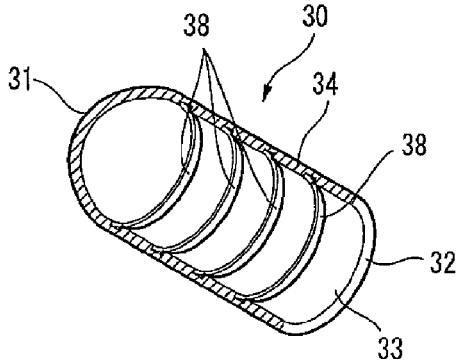
Figure 3:
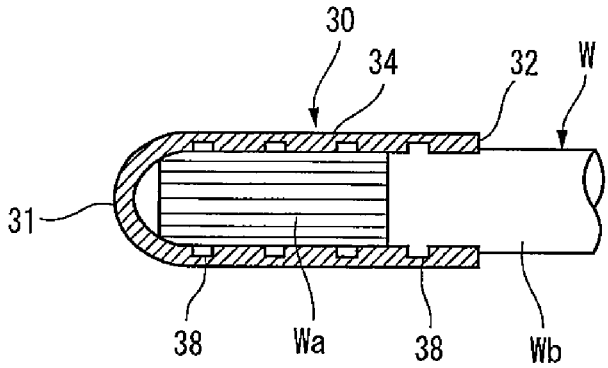
FIG. 3 is a sectional view showing a relation between the cap and the electric wire after crimping.

FIG. 1 is an explanatory diagram of the embodiment and is a completion perspective view and an exploded perspective view showing a relation among a crimping terminal, an electric wire and a cap, and FIG. 2(*a*) is an outline perspective view of the cap, and FIG. 2(*b*) is a sectional view showing an internal structure of the half-divided cap, and FIG. 3 is a sectional view showing a relation between the cap and the electric wire after crimping.

As shown in FIG. 1, this crimping terminal 10 is a female terminal, and has a box-shaped electric connection part 11, with a built-in spring piece, for making connection to the other terminal etc. (not shown) in the front of the crimping terminal, and has an electric wire connection part 12 crimped and connected to the distal end of an electric wire W through a joining part 13 in the back of the electric connection part 11.

The electric wire connection part 12 is formed in substantially a U shape in cross-section view by a base plate part 21 and a pair of electric wire crimp pieces 22 upwardly extending from both lateral edges of the base plate part 21, and includes a conductor crimping part 14 positioned in the front side and a coating crimp part 15 positioned in the back side of the conductor crimping part 14. In the present embodiment, the conductor crimping part 14 of the front side and the coating crimp part 15 of the back side are continuously formed in about the same width. The electric wire crimp pieces 22 are crimped so as to obtain a state in which the distal end of the electric wire W is brought into close contact with an upper surface of the base plate part 21 by inwardly bending the electric wire crimp pieces 22 so as to wrap the distal end of the electric wire W to be connected.

A metallic cap 30 as shown in FIGS. 2(*a*) and 2(*b*) is used for obtaining a connection structure of the embodiment. This cap 30 is formed of a metal (for example, copper or copper alloy) of the same kind as that of the crimping terminal 10, and also has a tubular peripheral wall 34 in which one end 31 of a longitudinal direction is closed and the other end 32 is opened, and has serrations (that is, recessed grooves having edges) 38 in the inner periphery of the tubular peripheral wall 34. The cap 30 has a length capable of covering the range from the front end of a conductor Wa in the distal end of the electric wire W to the portion having an insulating coating (hereinafter also called a coating simply) Wb, and the plural serrations 38 are respectively formed as continuous annular grooves at a proper spacing from the vicinity of an inlet 33 of the cap 30 toward the back of the cap 30 in the inner periphery of the tubular peripheral wall 34. Therefore, each of the serrations 38 intersects with a longitudinal direction of the electric wire W.

As shown in FIG. 3, after the conductor Wa with a proper length is exposed to the distal end of the electric wire W by removing the insulating coating Wb, the metallic cap 30 is attached to its distal end so as to cover the range from the conductor Wa to the portion having the coating Wb. Then, by crimping the electric wire crimp pieces 22 so as to surround this cap 30, the cap 30 and the distal end of the electric wire W are crushed and deformed and the electric wire W is connected to the crimping terminal 10. In that case, the connection structure of the embodiment is obtained by biting the conductor Wa and the coating Wb of the electric wire into the serrations 38 of the inner periphery of the crushed cap 30 (see FIG. 1).

According to the connection structure of the crimping terminal 10 to the electric wire W configured thus, the conductor Wa and the coating Wb of the electric wire W are bitten into the serrations 38 formed in the inner periphery of the cap 30, so that performance of electrical continuity between the cap 30 and the conductor Wa of the electric wire W can be improved and also, a force of bonding or adhesion between the cap and the coating Wb of the electric wire W can be increased by biting the coating Wb of the electric wire W into the serrations 38. Therefore, entrance of water is blocked at that bitten portion and even when a filler is not used, sufficient waterproof performance can be maintained. As a result, the need for a control item of the filler is eliminated and thereby, practicality improves more and ease-of-use improves.

Moreover, the cap 30 is constructed of a metal (that is, for example, constructed of copper or copper alloy) of the same kind as that of the crimping terminal 10, so that electrolytic corrosion does not occur even when water adheres to a part of contact between the cap 30 and the crimping terminal 10. Also, the serrations 38 into which at least the coating Wb is bitten intersect with the longitudinal direction of the electric wire W by being formed as the continuous annular grooves in the inner periphery of the tubular peripheral wall 34 of the cap 30, so that an entrance path of water is blocked at the portion in which the coating Wb is bitten into the serrations 38, and waterproof performance can be improved more surely.

In addition, the invention is not limited to the embodiment described above, and modifications, improvements, etc. can be made properly. Moreover, as long as the invention can be achieved, the number of components, materials, shapes, dimensions, arrangement places, etc. of each component in the embodiment described above are arbitrary and are not limited.

Figure 4:
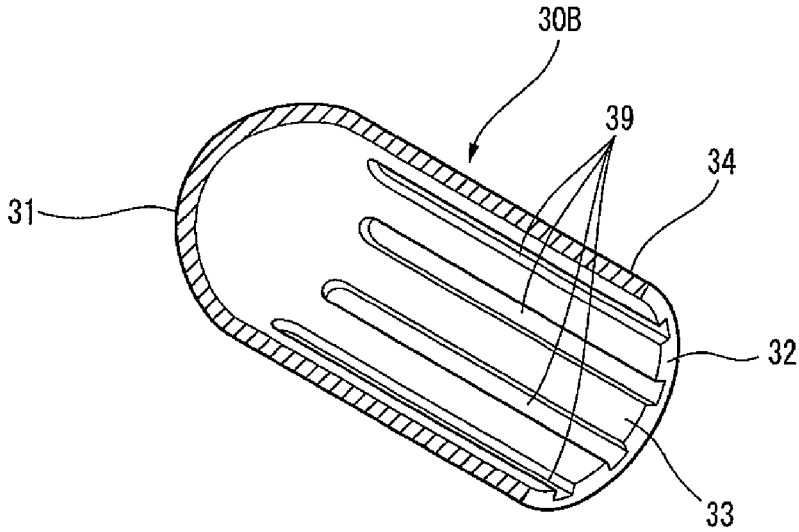
FIG. 4 is a sectional view showing an internal structure of a half-divided cap used in another embodiment of the invention.
Figure 5A:
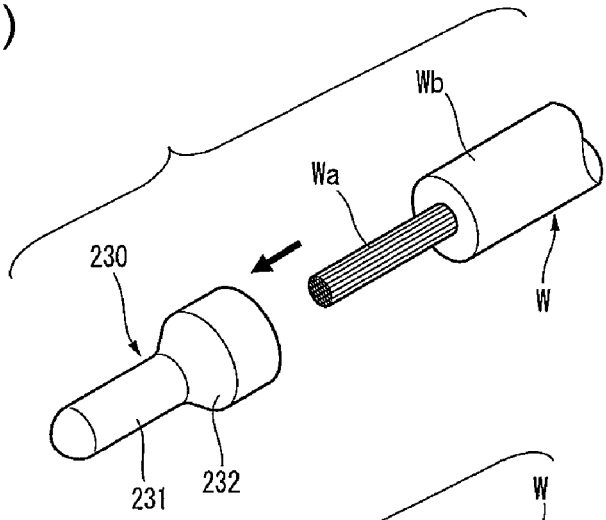
FIG. 5 is an explanatory diagram of a conventional connection structure between a terminal and an electric wire, and FIG. 5(*a*) is a perspective view showing a state in which the distal end of the electric wire attempts to be covered with a cap, and FIG. 5(*b*) is a perspective view showing a state in which the distal end of the electric wire covered with the cap attempts to be set in an electric wire connection part of the terminal, and FIG. 5(*c*) is a perspective view showing a state in which conductor crimp pieces of the electric wire connection part are crimped to the distal end of a conductor set in the electric wire connection part and the terminal is connected to the conductor.
Figure 5B:
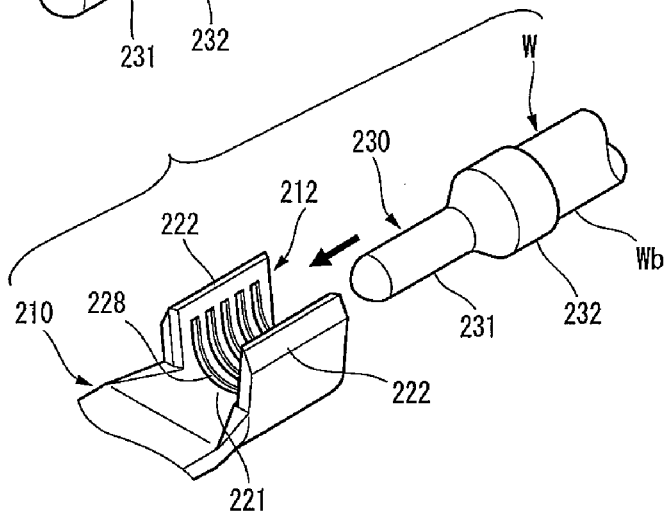
Figure 5C:
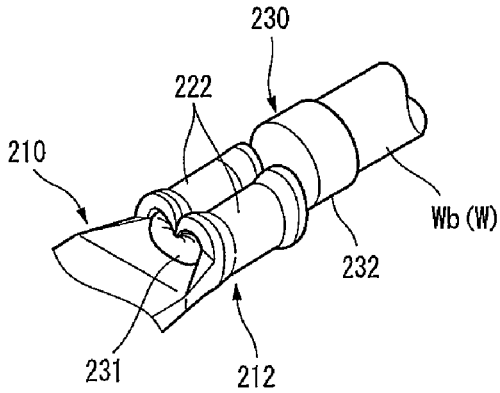

For example, as described in a cap 30B used in another embodiment shown in FIG. 4, serrations 39 formed in the inner periphery of a tubular peripheral wall 34 may be constructed so as to extend along a longitudinal direction of an electric wire.

Also, the invention may use any kind of electric wire, but can exert usefulness particularly when the crimping terminal is made of copper or copper alloy and the cap is made of copper or copper alloy and the electric wire is an aluminum electric wire.

The invention has been described in detail with reference to the specific embodiments, but it is apparent to those skilled in the art that various changes or modifications can be made without departing from the spirit and scope of the invention. The present application is based on Japanese patent application (patent application No. 2010-065085) filed on Mar. 19, 2010, and the contents of the patent application are hereby incorporated by reference.

DESCRIPTION OF REFERENCE NUMERALS AND SIGNS

W ELECTRIC WIRE
Wa CONDUCTOR
Wb INSULATING COATING
10 CRIMPING TERMINAL
11 ELECTRIC CONNECTION PART
12 ELECTRIC WIRE CONNECTION PART
14 CONDUCTOR CRIMPING PART
15 COATING CRIMP PART
21 BASE PLATE PART
22 ELECTRIC WIRE CRIMP PIECE
30 CAP
31 ONE END
32 THE OTHER END
34 TUBULAR PERIPHERAL WALL
38 SERRATION (ANNULAR GROOVE)
39 SERRATION

The invention claimed is:

1. A connection structure of a crimping terminal to an electric wire, wherein the crimping terminal comprises:

an electric connection part for making connection to the other terminal in a front of the crimping terminal; and an electric wire connection part formed in substantially a U shape in crosssection view and having a base plate part and a pair of electric wire crimp pieces in a back of the electric connection part, the electric wire crimp pieces upwardly extended from both lateral edges of the base plate part and crimped so as to obtain a state in which a distal end of the electric wire is brought into close contact with an upper surface of the base plate part by inwardly bending the electric wire crimp pieces so as to wrap the distal end of the electric wire to be connected;

wherein a metallic cap whose inner periphery is provided with a serration is attached to a conductor exposed by removing a portion of an insulating coating of the distal end of the electric wire so as to cover a range to the coating portion of the electric wire, and the conductor and the insulating coating of the electric wire are bitten into the serration by crimping the electric wire crimp pieces so as to surround the cap, wherein the cap is closed at a first end in a longitudinal direction and open at an opposing end.

2. The connection structure of the crimping terminal to the electric wire according to claim 1, wherein the cap has a tubular peripheral wall and the serration is formed as a continuous annular groove in an inner periphery of the tubular peripheral wall in a portion into which at least the insulating coating is bitten, and the serration intersects with a longitudinal direction of the electric wire.

3. The connection structure of the crimping terminal to the electric wire according to claim 1, wherein the cap is formed of a metal of the same kind as that of the terminal.

* * * * *